United States Patent [19]

Knapp et al.

[11] Patent Number: 4,554,690

[45] Date of Patent: Nov. 26, 1985

[54] WATER DISTRIBUTION SYSTEM FOR SHOWERS

[75] Inventors: Scott R. Knapp; Paul P. Kolada, both of Sheboygan, Wis.

[73] Assignee: Kohler Co., Kohler, Wis.

[21] Appl. No.: 662,318

[22] Filed: Oct. 18, 1984

[51] Int. Cl.[4] ..... A47K 3/22

[52] U.S. Cl. ..... 4/601; 4/567; 4/615; 4/596; 4/612; 4/663

[58] Field of Search ..... 4/601, 663, 596, 662, 4/605, 612, 615, 620, 597, 567; 239/450

[56] References Cited

U.S. PATENT DOCUMENTS

| | | | |
|---|---|---|---|
| 1,065,265 | 6/1913 | Nordmark | 4/601 |
| 2,100,186 | 11/1937 | Hagopian | 4/601 X |
| 2,336,402 | 12/1943 | Kaiser | 4/601 |
| 3,613,127 | 10/1971 | Bond | 4/601 X |
| 3,720,961 | 3/1973 | Garvey | 4/662 |
| 3,971,074 | 7/1976 | Yxfeldt | 4/601 X |
| 3,984,879 | 10/1976 | Ejchorszt | 4/601 |
| 4,397,050 | 8/1983 | Davis et al. | 4/601 |

FOREIGN PATENT DOCUMENTS

| | | | |
|---|---|---|---|
| 2217559 | 10/1973 | Fed. Rep. of Germany | 4/601 |
| 2460162 | 2/1981 | France | 4/601 |

*Primary Examiner*—Henry K. Artis

*Attorney, Agent, or Firm*—Quarles & Brady

[57] ABSTRACT

A water distribution system for a shower enclosure (1) including longitudinal water channels (20–24), each having an internal passage (36), and covering clips (60,70) secured to each of a pair of water channels at a corner therebetween.

3 Claims, 10 Drawing Figures

Fig. 7
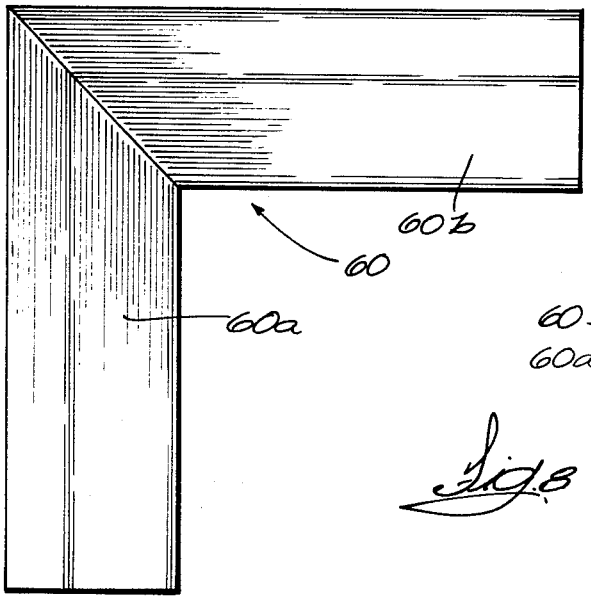
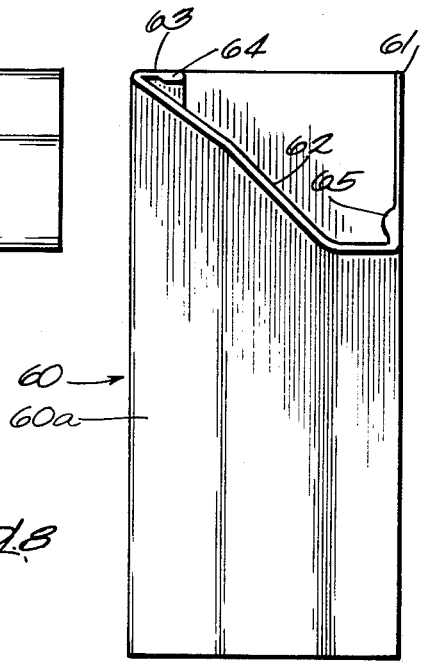
Fig. 8
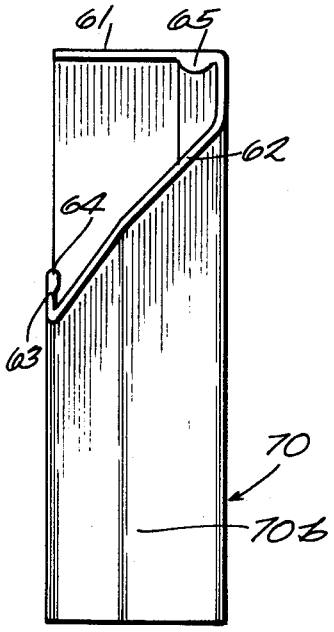
Fig. 10
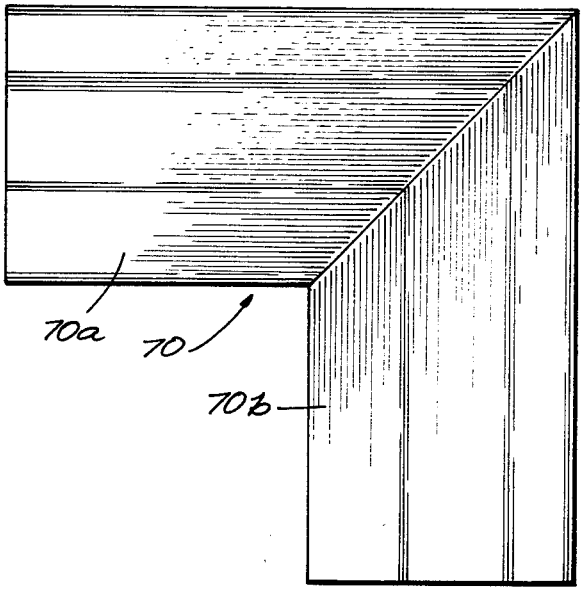
Fig. 9

WATER DISTRIBUTION SYSTEM FOR SHOWERS

TECHNICAL FIELD

This invention relates generally to showers, and more particularly to a water distribution system for attachment to the walls of a shower enclosure which is adapted to permit facile disposition of vertically arranged shower nozzles along one or more sides of a bather.

BACKGROUND ART

The typical shower stall installation, as is well known, has a single shower nozzle positioned in front of the bather. This is the principal arrangement of a shower nozzle, and there are numerous such installations worldwide.

There is a growing interest in shower installations that direct water over a larger area of a bather's body than is possible with a single frontal shower nozzle. One general purpose of this type of arrangement is to provide a stimulating, hygienic body massage effect by covering a large portion of a bather's body with shower water which may have either a pulsating or continuous flow or a combination of both. Typical examples of showers of this type that have been commercialized are those which employ a shower nozzle that travels vertically and those which use vertical rows of shower nozzles that must be connected through a wall of the shower to water supply pipes. The present invention was developed as a result of the belief that prior art systems of these types have limitations and disadvantages when used with both existing and new shower installations. A main object of this invention was to devise a water channel system for multiple row showers that can be readily installed in new shower units, as for example one piece molded plastic shower stalls. Another main object of this invention was to develop a water channel system for showers that can be easily fitted to modify existing shower installations to incorporate one or more vertical rows of shower nozzles without the need for through-wall plumbing connections. A more specific object was to invent a water channel system for showers that can be connected to existing external shower plumbing and secured to the inner surface of the walls of a shower enclosure so as to thereby eliminate the need for through wall plumbing connections.

DISCLOSURE OF THE INVENTION

The present invention relates to a water distribution system for showers including a plurality of water channels, each having an internal longitudinally-extending water passage, and corner clips designed to cover connections between channels at the corners of a shower enclosure. The water channels and the corner clips are structured such that a corner clip can be snapped onto two channels. In addition, the water channels are adapted to be adhesively attached to the interior surfaces of the walls of a shower enclosure. One or more of the water channels may be arranged vertically and carry nozzles through which water is directed onto a bather.

BRIEF DESCRIPTION OF THE DRAWINGS

The present invention is described in full and concise detail to explain its principals to those skilled in the art and set forth a presently-preferred embodiment by reference to the following drawings, in which:

FIG. 7 is a top view of a corner clip used between two horizontally arranged water channels;

FIG. 8 is an end view of the corner clip of FIG. 7;

FIG. 9 is a front view of a corner clip employed between a horizontal water channel and a vertical water channel; and FIG. 10 is an end view of the corner clip of FIG. 9.

BEST MODES FOR CARRYING OUT THE INVENTION

Figure 1:
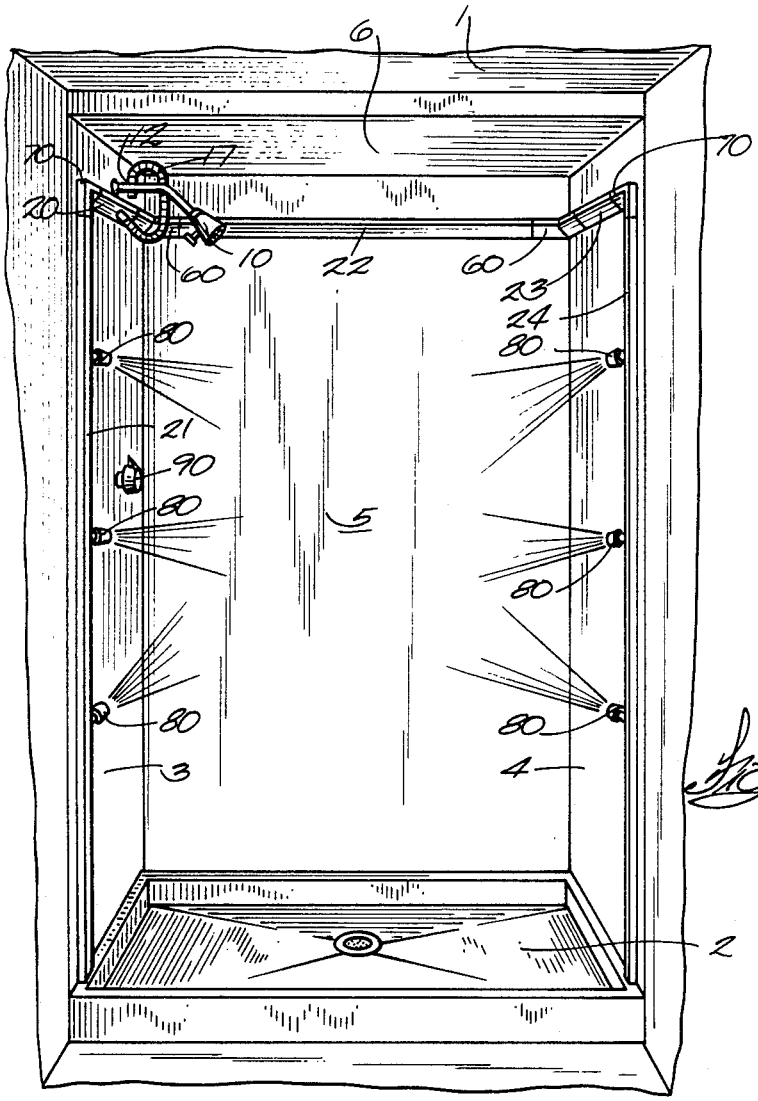
FIG. 1 is a perspective view of a shower enclosure including a water distribution system according to the present invention.

FIG. 1 illustrates a shower enclosure 1 including a floor 2, side walls 3 and 4, rear wall 5 and a ceiling 6. The open side of the enclosure would normally be covered by a shower curtain or door when in use. The enclosure 1 may be a molded plastic unit manufactured as an integral enclosure adapted to be installed in new construction or as a replacement or addition to an existing installation. Also, however, the enclosure 1 may be an existing shower enclosure, typically having tiled walls, or a multipiece shower of the wall surround type.

Figure 4:
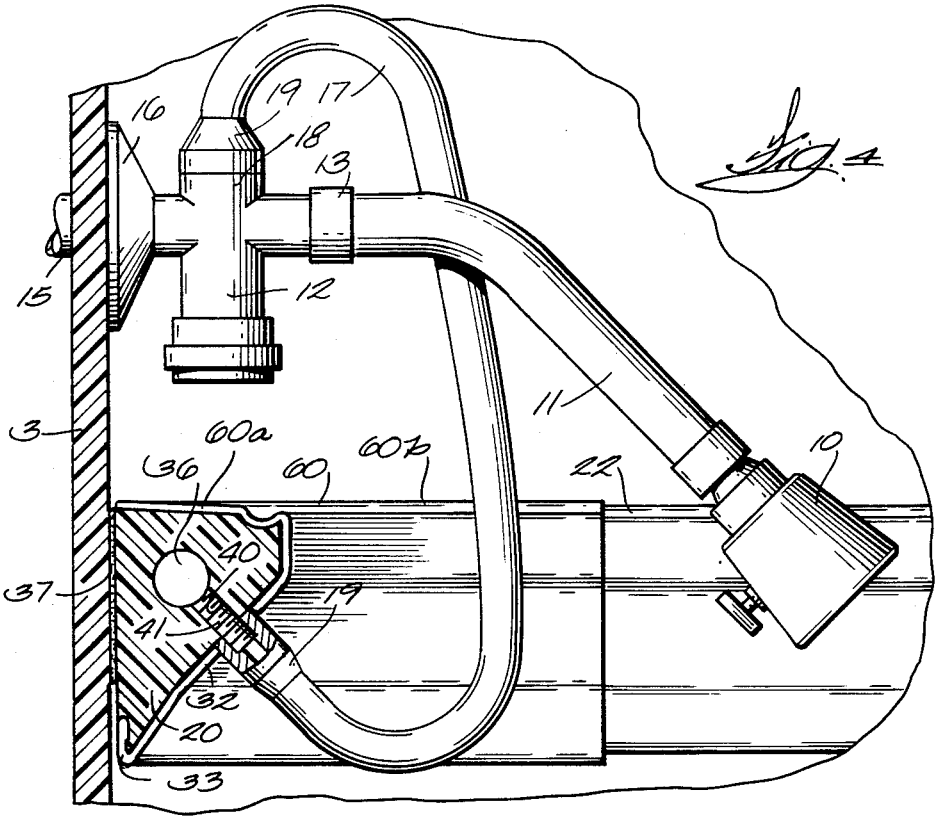
FIG. 4 is a side view of a portion of the shower enclosure of FIG. 1 to illustrate details of the connection of the present water distribution system to the existing plumbing for a shower nozzle.

A frontal shower nozzle 10 is carried on a shower arm 11, referring now especially to the detailed view of FIG. 4, which is connected to a branch of a diverter valve 12 by means of a union 13. An opposite branch of the diverter valve is connected to a water supply pipe 15 which extends through the side wall 3 of the shower enclosure and is part of the internal plumbing of the building in which the shower is located. Escutcheon 16 covers a portion of the supply pipe located inside the shower. One end of a flexible conduit 17 is secured by means of coupling 18 to a third branch of the diverter valve 12. The opposite end of the flexible conduit 17 is attached by means of coupling 19 to a water channel 20 of the present invention. The arrangement thusly described enables the bather to direct water either through the nozzle 10 or to the water distribution system including the water channel 20, as described hereinafter, upon actuation of the diverter valve 12.

Returning to FIG. 1, the water channel 20 is horizontally positioned and extends across the side wall 3 of the shower enclosure 1. At its front corner, i.e. the corner at the front of FIG. 1, the water channel 20 is connected to a vertical water channel 21 which extends along a substantial portion of side wall 3. At its rear corner, the water channel 20 is connected to water channel 22 that extends horizontally across the rear wall 5. Channel 22 is connected to a horizontal water channel 23 extending mostly across side wall 4 of the enclosure. At its front corner, water channel 23 is connected to vertical water channel 24 that extends along a substantial portion of side wall 4. Five water channels are employed in the illustrative embodiment, but any number of channels can be used to form a water distribution system for a particular shower enclosure, the minimum number being a pair of water channels. Water channels 20, 21, 22, 23 and 24 are longitudinal elements of the same construction, which is described next in connection with water channel 20 illustrated in FIGS. 2 and 3.

Figure 3:
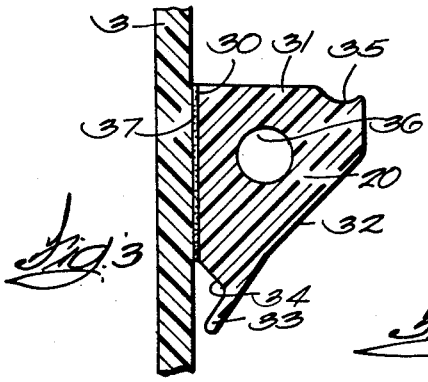
FIG. 3 is an end view in section of the water channel illustrated in FIG. 2.
Figure 2:
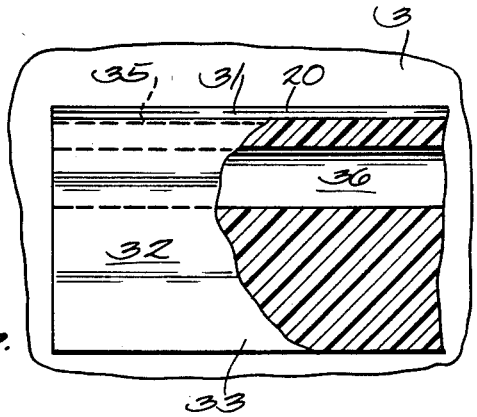
FIG. 2 is a front view, with portions broken away and partly in section, of a water channel of this invention.

Turning to FIGS. 2 and 3, water channel 20 is an extruded plastic member of selected length that in profile (FIG. 3) includes a rear wall 30, a first wall 31 extending at approximately a right angle from the rear wall, and a second wall 32 that extends from the outer edge of first wall 31 and is inclined towards the rear wall. At the portion of the second wall 32 remote from the first wall 31, a wing 33 extends from the second wall that is spaced from the rear wall 30 and separated therefrom by a short spacer portion 34.

The first wall 31 has a longitudinally extending groove 35 along its outer edge portion remote from the rear wall 30. The water channel 20 has an internal water passage 36 which extends longitudinally internally of, or within, the channel and may be circular in cross section as shown in the drawings. The water channel 20 (FIG. 3) is secured to the interior surface of the side wall 3, i.e. the surface of the wall inside the shower enclosure, by means of a layer of adhesive 37 between the rear wall 30 of the channel and the wall 3.

The water channels 20–24 are to be manufactured as extruded plastic elements. The channels may be made of any appropriate material such as various types of polyvinyl chlorides, polyolefins, nylons, etc. The presently preferred material for the water channels is polyvinyl chloride. The adhesive 37 employed to attach a water channel to the interior surface of the wall of a shower enclosure can be any suitable structural adhesive appropriate to the material of the wall surface and the material of the water channel. Various commercially available adhesives may be employed for this purpose, including hot melt adhesives, two side coated adhesive tapes, pressure sensitive adhesives, etc. The adhesive layer may extend continuously along the rear wall 30 of a water channel, or it may be applied as spaced zones or discrete areas, or patterns of adhesive. Although not shown in the drawings, the rear wall 30 of a water channel may include a shallow notch or well portion in which the adhesive is received.

FIG. 4 is a detailed view of the connection between the flexible conduit 17 and water channel 20. A hole 40 is drilled through the wall 32 of water channel 20 to communicate with the water passage 36 at the desired location for the connection. A pipe nipple 41 is threaded into the hole 40, and a portion of the nipple projects outwardly from the wall 32 of the channel. Coupling 19 of the flexible conduit 17 is threaded onto the extending portion of the pipe nipple 41 to form the connection. When the diverter valve 12 is suitably actuated, water flows through the flexible conduit 17, hole 40 and into the longitudinally extending water passage 36 of the water channel 20.

Figure 5:
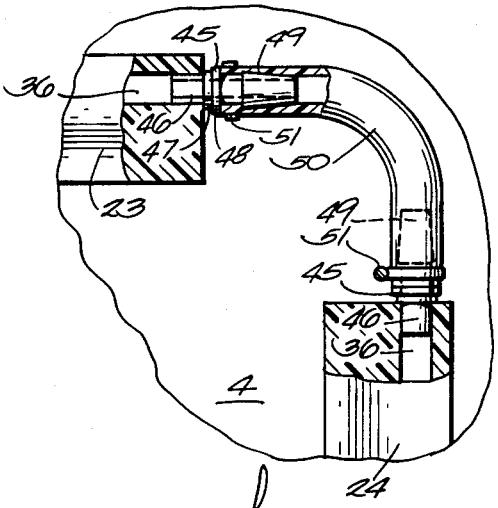
FIG. 5 is a front view, partly in section and with portions broken away, illustrating a corner connection between two water channels of the present invention.

The manner of connecting two water channels at a corner of the shower enclosure is illustrated in FIG. 5 with reference to the connection between horizontal water channel 23 and vertical water channel 24 at a front corner of the assembly along the side wall 4. A hollow plastic fitting 45 has a shank portion 46 that is seated in the water passage 36 of a channel and may be sealed thereto by means of appropriate sealants. Flange 47 of the fitting, which is slightly larger in diameter than the shank 46, is seated against the end of a channel 23 or 24 as illustrated in the drawing. A second flange 48 is formed adjacent to the flange 47 and is slightly larger in diameter than the flange 47. The opposite end of the fitting 45 includes a conical portion 49, the base of which is larger in diameter than the body of the fitting. To make the connection between two water channels at a corner, a flexible hose 50 is inserted onto a fitting 45 until its end rests against a flange 48 (which flange is preferably of approximately the same outer diameter as the hose) and secured in place upon each fitting by means of a hose clamp 51. Flexible hose 50 is preferably plastic hose, although other materials such as rubber or metal may be used if so desired, and the conical portion 49 of a fitting is employed to ensure a tight connection between the inner wall of the hose and the conical portion of a fitting 45. A corner connection of the type shown in FIG. 5 is made at the corner between water channels 20 and 21, channels 20 and 22, channels 22 and 23, and channels 23 and 24. This corner connection unites the channels 20–24 into a water distribution system having a continuous water passage 36 arranged horizontally and vertically inside the shower enclosure 1.

The corner connections between water channels are covered by corner clips that are to be snapped onto the channels at the various corners. A corner clip 60 of the type to be secured between two horizontal water channels is illustrated in FIGS. 7 and 8, and would be used, for example, at a corner between the channels 20 and 22 and the channels 22 and 23 (see FIG. 1). The corner clip 60 has horizontal legs **60*a* and 60*b* which meet each other at right angles. The legs 60*a* and 60*b* are both of the same construction, and each includes a first wall 61 and a second wall 62 extending from an outer edge of the wall 61 and having a main portion at an angle thereto as best shown in cross section in FIG. 8. A tab 63 extends from the edge of the wall 62 remote from the wall 61 and is slightly spaced from the wall 62; the outer edge of the tab 63 may include an enlarged portion 64 as illustrated in FIG. 8. The interior surface of the wall 61 near the juncture with the wall 62 has a projecting boss 65 that extends longitudinally along the length of a wall 61**.

The corner clip 70 shown in FIGS. 9 and 10 includes a horizontal leg **70*a* and a vertical leg 70*b* arranged at right angles to one another as illustrated and is used to cover the corner connection between a horizontal and a vertical water channel, such as the corner between channel 20 and channel 21 and the corner between channel 23 and channel 24 (FIG. 1). The legs 70*a* and 70*b* of corner clip 70 are of the same structure as the legs 60*a* and 60*b* of the corner clip 60 shown in FIGS. 7 and 8, and these elements of the clip 70** are identified by the same reference numerals.

The corner clips 60 and 70 also are made of plastic material, and may, for example, be made of injection molded polyvinyl chloride or ABS plastic. It has been found that corner clips with walls approximately 0.05 inches thick and legs about 4 inches long were satisfactory in prototype testing of the present system, and it has been found desirable to taper the thickness of the walls to about 0.03 inches over an area of about 1 inch at each outer end of the clips.

The installation of a corner clip 60 is illustrated in FIG. 4 covering the corner between water channel 20 and water channel 22. Channels 20 and 22 are connected across the corner by hose 50 in the manner illustrated in FIG. 5. A corner clip 60 is then installed so as to cover the hose connection between the two water channels. As shown in FIG. 4, a portion of the leg 60*a* of corner clip 60 extends over the channel 20 and a portion of the leg 60*b* of the corner clip extends over the channel 22. It will be noted that the wall 61 of the corner clip 60 extends over a portion of the first wall 31 of the channel 20; further, the longitudinally extending boss 65 of the wall 61 of the corner clip fits into the groove 35 formed in the wall 31 of the channel. The wall 62 of the corner clip 60 is shaped so as to conform generally to the shape of the second wall 32 of the channel and is long enough to extend over the second wall 32 and wing 33. The tab 63 of the corner clip is positioned behind the wing 33 of the channel 20 along a side thereof opposite from the second wall 62 of the corner clip. Thus the coaction between the boss 65 of the corner clip and groove 35 of each of the channels 20 and 22 and the fit of the tab 63 of the corner clip behind the wing 33 of each of the channels 20 and 22 serve to retain the corner clip in position on both the channels 20 and 22. In this fashion, the clip is securely held in place and serves to cover the hose connection at the corner between the two channels. The thinned end portions of the corner clip mentioned in the preceding paragraph facilitate the snap fitting of the end portions of a corner clip about the channels. The plastic material chosen for the corner clip 60 most usefully has a slight resiliency so that the clip will snugly fit onto the channels and so that the tab 63 can be bent sufficiently so as to be positioned behind the wing 33 of a channel.

Returning now to FIG. 1, the vertical channels 21 and 24 each include a plurality of spaced shower nozzles 80, three such nozzles on each vertical channel being shown in the illustrative embodiment although a different number may be used if desired. Water is to be directed from the nozzles 80 onto a bather, and the number of nozzles and the spacing between the nozzles should be selected in accordance with the extent of a person's body which it is desired to have the shower water cover or impinge upon.

Figure 6:
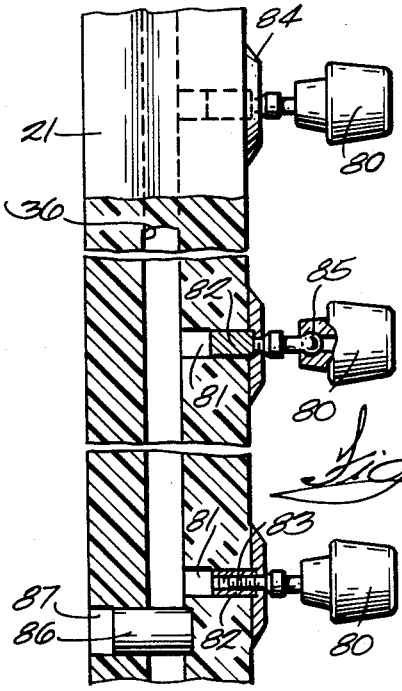
Fig. 6 is a side view, partly in section and with portions broken away, of one of the vertical channels incorporated in the enclosure of FIG. 1.

The attachment of nozzles 80 to a channel is illustrated in detail in FIG. 6 by reference to channel 21, it being understood that the connections are the same with respect to channel 24. Referring first to the middle nozzle 80 shown in FIG. 6, a hole 81 is drilled through the channel 21 so as to communicate with the longitudinal water passage 36. A hollow fitting 82 having an internal threaded passage is fit into the hole 81 and preferably sonic welded to the plastic material of the channel. The fitting 82 is preferably of metal such as brass and its external surface may include serrations or other surface texture features in order to enhance its connection with the channel 21. Turning now to lower nozzle 80 as illustrated in FIG. 6, each nozzle 80 includes a shank portion 83 that is threaded into the threaded inner passage of a fitting 82. An appropriate sealant is used to form a watertight connection between a nozzle 80 and a fitting 82 and between a fitting 82 and channel 21. The nozzles 80 may have a ball joint 85 in order that the user can swivel the nozzles to adjust the direction of the spray. As illustrated with respect to the top nozzle 80 shown in FIG. 6, the juncture of a nozzle with the channel may be covered by an escutcheon 84. Lastly, the end of the internal longitudinal water passage 36 formed in the channel 21 is closed off by a plug 86 that is inserted into a hole 87 drilled from the rear wall 30 of the water channel to extend across the water passage 36. The plug 86 may be held in place with suitable liquid sealant so as to ensure a substantially watertight fit between the plug and the channel.

Returning now to FIG. 1, when the bather turns on the faucet 90 in the shower enclosure and actuates the diverter valve 12 so as to direct water through the flexible conduit 17 into the water distribution means established by the channels 20–24, water will be directed onto the bather's body through the two vertical rows of nozzles 80 from the channels 21 and 24. With this type of installation, the water will cover a large portion of the bather's body. Further the nozzles 80 may be of the type adapted to deliver a pulsating stream of water to thereby achieve a massaging effect.

There has thus been described a water distribution system adapted particularly for attachment to the interior surfaces of the walls of a shower enclosure which comprises at least a pair of water channels of the construction described above having internal water passages through which water is conducted through nozzles attached to one or more of the channels of the assembly. The novel water channels described above are extruded plastic elements which can be adhesively joined to the interior surfaces of the walls of the shower enclosure, thereby eliminating the need for mechanical fastening means. Connections between channels at corners of the enclosure are readily made. Further, the connection of the water distribution system employing the present water channels to a shower head in an enclosure is easily made with readily available plumbing fittings. Corner clips are employed as an important element of the present invention so as to cover the connections between channels at a corner of the enclosure. The water distribution system of this invention has been carefully designed and engineered to be readily installed by a manufacturer of shower enclosures so that it can be used as factory installed equipment. Also, however, the distribution system of this invention can be installed in an existing shower enclosure by either a professional or a do-it-yourselfer. The system of the present invention has been developed to provide, for example, one or more vertical rows of shower nozzles in a shower enclosure and has met this objective in an economical manner utilizing elements that can effectively enable this type of installation without the need for expensive or unusual fittings or other equipment. As another advantage, all of the plumbing connections and elements of the water distribution system of this invention are located inside the shower enclosure, so that there is no need to make connections between the present water distribution system and water supply pipes located outside of the shower enclosure, such as in the walls of a building.

While the present invention has been described above by reference to a presently-preferred embodiment and several variations from the illustrated embodiment have been described, it is anticipated that those skilled in the art will be able to devise other modifications that will differ from the illustrated embodiment but remain within the true scope of the present invention and it is desired that the appended claims shall encompass all such obvious modifications of this invention as disclosed above.

We claim:

1. A water distribution system for a shower enclosure of the type having a pair of opposed walls connected by a third wall and a shower nozzle inside the enclosure connected to a water supply pipe, comprising in combination:

(I) at least a pair of water channels attached to interior surfaces of the walls of the shower enclosure, each water channel consisting of an extruded plastic longitudinal element including a longitudinally-extending water passage defined internally thereof and a wall adhesively attached to interior wall surfaces of the enclosure;

(II) the water channels being arranged at about right angles to each other with one channel positioned horizontally and the other positioned either vertically or horizontally with an end of one channel spaced from an end of another channel at a corner between the channels, a flexible water conduit connected to the water passage of each channel between said spaced ends for conducting water from one channel to the other;

(III) a covering clip having a pair of legs and arranged to cover said flexible conduit with one leg of the covering clip secured to one channel at the corner and the other leg secured to the other water channel at the corner;

(IV) conduit means connected to at least one of said channels for supply of water thereto from inside the enclosure; and (V) shower attached to at least one of said water channels and communicating with the water passage thereof for direct water onto a bather.

2. A water distribution system according to claim 1, wherein:

(a) water channel includes (1) a rear wall, (2) a first wall extending at about a right angle from the rear wall, (3) a second wall extending from an edge of the first wall remote from the rear wall and (4) a wing extending from an edge of the second wall remote from the first wall and spaced from the rear wall of the channel, and (b) each leg of a covering clip has (1) a first wall extending along the first wall of a water channel, (2) a second wall extending along the second wall of a water channel, and (3) a tab extending along the wing of a channel at a side thereof opposite from the second wall of the covering clip.

3. A water distribution system according to claim 2, wherein:

the first wall of each channel includes a longitudinally-extending groove, the first wall of each covering clip includes a longitudinally-extending boss projecting from an interior surface thereof to engage said longitudinally-extending groove.

* * * * *

UNITED STATES PATENT AND TRADEMARK OFFICE

CERTIFICATE OF CORRECTION

PATENT NO. : 4,554,690

DATED : November 26, 1985

INVENTOR(S) : Scott R. Knapp and Paul Kolada

It is certified that error appears in the above-identified patent and that said Letters Patent is hereby corrected as shown below:

Column 8, line 4, after "shower" insert --nozzles--.
Column 8, line 6, delete "direct" and substitute --directing--.
Column 8, line 9, after "(a)" insert --each--.

Signed and Sealed this

*Fourth* Day of *March 1986*

[SEAL]

*Attest:*

DONALD J. QUIGG

*Attesting Officer*

*Commissioner of Patents and Trademarks*